US011827480B2

(12) United States Patent
Valenzuela-Rivas et al.

(10) Patent No.: US 11,827,480 B2
(45) Date of Patent: Nov. 28, 2023

(54) AUTOMATIC DOCUMENT FEEDER WITH AUTOMATED MEDIA TRAY

(71) Applicant: Hewlett-Packard Development Company, L.P., Spring, TX (US)

(72) Inventors: Rene O. Valenzuela-Rivas, San Diego, CA (US); Ryan M. Smith, San Diego, CA (US); Ki Jung Han, Vancouver, WA (US); Michael V. Leman, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/298,594

(22) PCT Filed: Jul. 31, 2019

(86) PCT No.: PCT/US2019/044458
§ 371 (c)(1),
(2) Date: May 30, 2021

(87) PCT Pub. No.: WO2021/021183
PCT Pub. Date: Feb. 4, 2021

(65) Prior Publication Data

US 2022/0002109 A1 Jan. 6, 2022

(51) Int. Cl.
*B65H 31/02* (2006.01)
*B65H 5/00* (2006.01)

(52) U.S. Cl.
CPC ..... *B65H 31/02* (2013.01); *B65H 5/006* (2013.01); *B65H 2301/433* (2013.01); *B65H 2405/1117* (2013.01); *B65H 2405/11151* (2013.01); *B65H 2405/324* (2013.01); *B65H 2405/3322* (2013.01); *B65H 2511/214* (2013.01); *B65H 2511/51* (2013.01); *B65H 2511/515* (2013.01); *B65H 2801/15* (2013.01)

(58) Field of Classification Search
CPC ..... B65H 7/02; B65H 2405/324; B65H 2511/511
See application file for complete search history.

(56) References Cited

U.S. PATENT DOCUMENTS 4,085,929 A 4/1978 Tuchiya et al.
4,440,387 A 4/1984 Koma et al.
(Continued)

FOREIGN PATENT DOCUMENTS

CN 1522867 A 8/2004
CN 101221396 A 7/2008
(Continued)

OTHER PUBLICATIONS

"Original Tray Pre-rise Setting: Adjusting the Original Tray Standby Position on the ADF," Konica Minolta, retrieved at https://manuals.konicaminolta.eu/ineo-plus-2060L-2060-2070/EN/contents/id06-_102708692.html, retrieved on Nov. 19, 2018, 2 pages.

*Primary Examiner* — Howard J Sanders
(74) *Attorney, Agent, or Firm* — Brooks, Cameron & Huebsch, PLLC

(57) ABSTRACT

An automatic document feeder includes a media path to route media through the automatic document feeder, and an automated media tray to receive the media from the media path, with the automated media tray to be positioned based on input of the media to the media path.

16 Claims, 7 Drawing Sheets

(56) References Cited

U.S. PATENT DOCUMENTS

| | | | | |
|---|---|---|---|---|
| 4,486,015 | A | 12/1984 | Takahashi | |
| 4,887,133 | A | 12/1989 | Ikeda et al. | |
| 5,284,335 | A | 2/1994 | Golicz | |
| 5,430,536 | A | 7/1995 | Fullerton et al. | |
| 5,501,445 | A | 3/1996 | Lowman et al. | |
| 5,513,017 | A | 4/1996 | Knodt et al. | |
| 5,746,528 | A | 5/1998 | Mayer et al. | |
| 5,760,919 | A | 6/1998 | Acquaviva et al. | |
| 5,832,356 | A | 11/1998 | Kurando et al. | |
| 5,897,113 | A * | 4/1999 | Kondo | B65H 31/20 271/223 |
| 5,956,161 | A | 9/1999 | Takashimizu et al. | |
| 6,073,925 | A | 6/2000 | Sato | |
| 6,095,517 | A | 8/2000 | Dinatale | |
| 6,128,455 | A | 10/2000 | Horiguchi et al. | |
| RE37,157 | E | 5/2001 | Ikeda et al. | |
| 6,350,072 | B1 | 2/2002 | Nunes et al. | |
| 6,577,825 | B1 | 6/2003 | Gonnella et al. | |
| 6,641,132 | B2 | 11/2003 | Sekine | |
| 7,070,350 | B2 * | 7/2006 | Inokuchi | B41J 11/006 400/54 |
| 7,139,108 | B2 | 11/2006 | Andersen et al. | |
| 7,222,955 | B2 | 5/2007 | Ohashi et al. | |
| 7,242,901 | B2 | 7/2007 | Oya et al. | |
| 7,290,952 | B2 * | 11/2007 | Kagami | B65H 31/02 347/108 |
| 7,395,026 | B2 | 7/2008 | Seo et al. | |
| 7,461,837 | B2 | 12/2008 | Saito et al. | |
| 7,661,675 | B2 | 2/2010 | Lan et al. | |
| 7,731,179 | B2 | 6/2010 | Izuchi et al. | |
| 7,731,184 | B2 | 6/2010 | Lo et al. | |
| 7,819,395 | B2 | 10/2010 | Farmer | |
| 7,905,482 | B2 | 3/2011 | Matsumoto | |
| 7,963,516 | B2 | 6/2011 | Bokelman et al. | |
| 8,016,283 | B2 | 9/2011 | Ueda et al. | |
| 8,038,143 | B2 | 10/2011 | Watanabe | |
| 8,144,377 | B2 | 3/2012 | Wang et al. | |
| 8,237,999 | B2 | 8/2012 | Kusama | |
| 8,360,425 | B2 | 1/2013 | Chng et al. | |
| 8,544,840 | B2 | 10/2013 | Ng et al. | |
| 8,582,183 | B2 | 11/2013 | Westcott et al. | |
| 8,585,035 | B2 | 11/2013 | Ohama et al. | |
| 8,590,882 | B2 | 11/2013 | Furuyama et al. | |
| 8,730,532 | B2 | 5/2014 | Chun-Yu | |
| 9,116,484 | B2 | 8/2015 | Masumoto et al. | |
| 9,274,480 | B1 | 3/2016 | Wynn | |
| 9,670,026 | B2 | 6/2017 | Watanabe et al. | |
| 9,771,133 | B2 | 9/2017 | Palmer | |
| 9,771,233 | B2 | 9/2017 | Miura et al. | |
| 9,781,283 | B1 | 10/2017 | Wilsher et al. | |
| 2003/0038992 | A1 | 2/2003 | Emmenegger et al. | |
| 2004/0022452 | A1 | 2/2004 | McCoy | |
| 2004/0065132 | A1 | 4/2004 | Tschesche | |
| 2004/0113352 | A1 | 6/2004 | Chiang | |
| 2005/0162494 | A1 | 7/2005 | Nokuchi et al. | |
| 2006/0170950 | A1 | 8/2006 | Seike et al. | |
| 2007/0003339 | A1 | 1/2007 | Edwards et al. | |
| 2007/0003343 | A1 | 1/2007 | Washnock et al. | |
| 2007/0013120 | A1 | 1/2007 | Lo et al. | |
| 2007/0063425 | A1 | 3/2007 | Tsujinishi | |
| 2007/0227332 | A1 | 10/2007 | Causse et al. | |
| 2008/0037078 | A1 | 2/2008 | Chen | |
| 2008/0124120 | A1 | 5/2008 | Kang | |
| 2009/0010697 | A1 | 1/2009 | Nishimura et al. | |
| 2009/0045565 | A1 | 2/2009 | Edwards et al. | |
| 2009/0085277 | A1 | 4/2009 | Cook et al. | |
| 2009/0213436 | A1 | 8/2009 | Takuwa | |
| 2009/0278302 | A1 * | 11/2009 | Bokelman | B65H 3/0684 271/145 |
| 2010/0118327 | A1 | 5/2010 | Caspar et al. | |
| 2010/0294766 | A1 | 11/2010 | Wang et al. | |
| 2010/0309528 | A1 | 12/2010 | Nacman et al. | |
| 2011/0142516 | A1 | 6/2011 | Uchida | |
| 2011/0188085 | A1 | 8/2011 | Oosaki et al. | |
| 2012/0019874 | A1 | 1/2012 | Schaertel et al. | |
| 2012/0044513 | A1 | 2/2012 | Park et al. | |
| 2012/0178563 | A1 | 7/2012 | Lee et al. | |
| 2012/0188617 | A1 | 7/2012 | Klausbruckner | |
| 2012/0242769 | A1 | 9/2012 | Murray et al. | |
| 2012/0274994 | A1 | 11/2012 | Westcott et al. | |
| 2012/0274995 | A1 | 11/2012 | Westcott et al. | |
| 2012/0327458 | A1 | 12/2012 | Baba et al. | |
| 2013/0088762 | A1 | 4/2013 | Yamazaki et al. | |
| 2014/0168717 | A1 | 6/2014 | Schaertel et al. | |
| 2015/0104202 | A1 | 4/2015 | Caneza et al. | |
| 2015/0304513 | A1 | 10/2015 | Tu et al. | |
| 2016/0185558 | A1 | 6/2016 | Kamichi | |
| 2017/0107072 | A1 | 4/2017 | Nakamura | |
| 2017/0320701 | A1 | 11/2017 | Hale et al. | |
| 2017/0343083 | A1 | 11/2017 | Wright et al. | |
| 2018/0007221 | A1 | 1/2018 | Mokuo et al. | |
| 2018/0029387 | A1 | 2/2018 | Fujino | |
| 2018/0178563 | A1 | 6/2018 | Tamai | |
| 2020/0239247 | A1 | 7/2020 | Huang et al. | |

FOREIGN PATENT DOCUMENTS

| | | | |
|---|---|---|---|
| CN | 102588097 | A | 7/2012 |
| CN | 202784939 | U | 3/2013 |
| CN | 107435714 | A | 12/2017 |
| EP | 1591262 | A2 | 11/2005 |
| EP | 1971121 | A2 | 9/2008 |
| GB | 0836378 | A | 6/1960 |
| JP | 06-148982 | A | 5/1994 |
| JP | 09-258498 | A | 10/1997 |
| JP | 2015-141386 | A | 8/2015 |
| JP | 2016-175739 | A | 10/2016 |
| JP | 2018-005197 | A | 1/2018 |
| TW | M406892 | U | 7/2011 |
| WO | 2005/118443 | A2 | 12/2005 |
| WO | 2013/008928 | A1 | 1/2013 |
| WO | 2017/147251 | A1 | 8/2017 |

* cited by examiner

AUTOMATIC DOCUMENT FEEDER WITH AUTOMATED MEDIA TRAY

BACKGROUND

An automatic document feeder may be used for automatically transporting a sheet of media to an imaging or scanning position for copying, scanning, faxing, displaying on a monitor, or other processing. Thereafter, the automatic document feeder may eject the media and process a next sheet of media.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1A:
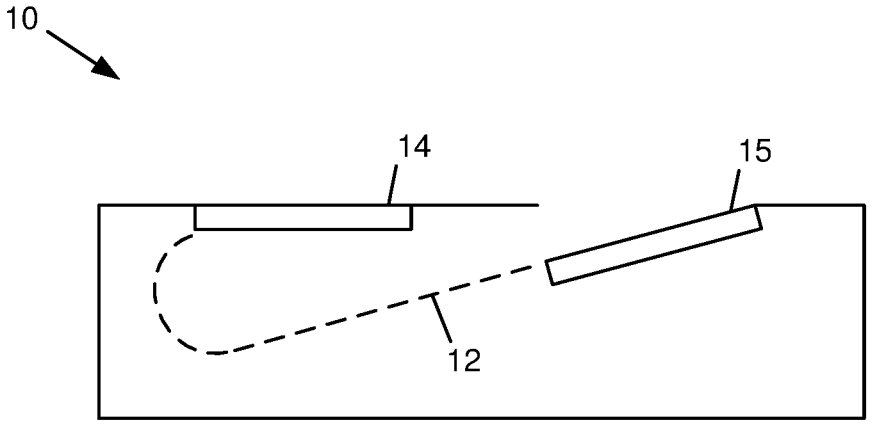
FIGS. 1A and 1B are block diagrams illustrating an example of an automatic document feeder including an automated media tray in a closed position and an open position, respectively.
Figure 1B:
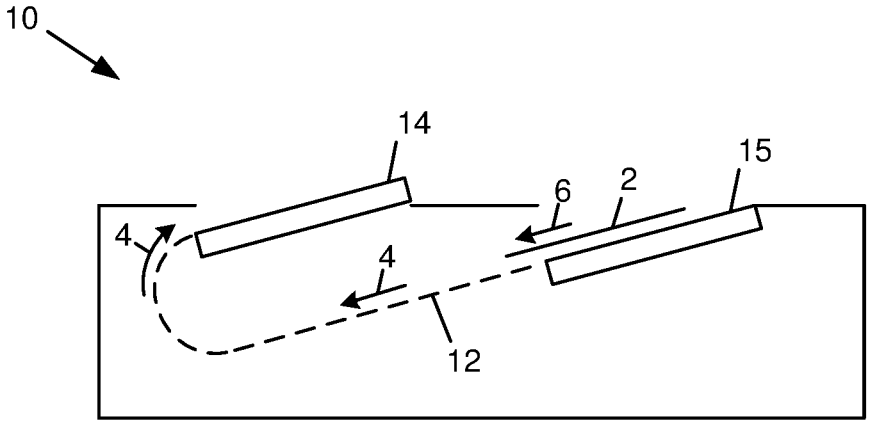

As illustrated in the example of FIGS. 1A and 1B, the present disclosure provides an automatic document feeder (ADF) 10. In one implementation, ADF 10 includes a media path 12 to route media 2 through ADF 10, as represented by arrows 4, and an automated media tray 14. In examples, automated media tray 14 is an output tray to receive media 2 from media path 12. As such, in examples, ADF 10 includes an input tray 15 to supply media 2 to media path 12.

In examples, automated media tray 14 is to be positioned based on input of media 2 to media path 12. For example, as illustrated in the example of FIG. 1A, without input of media 2 to media path 12, automated media tray 14 is in (e.g., moved to or changed to) a closed positon, and, as illustrated in the example of FIG. 1B, with input of media 2 to media path 12, as represented by arrow 6, automated media tray 14 is in an open positon. As such, as illustrated in the example of FIG. 1A, without input of media 2 to media path 12, automated media tray 14 is non-communicated with media path 12, and, as illustrated in the example of FIG. 1B, with input of media 2 to media path 12, as represented by arrow 6, automated media tray 14 is communicated with media path 12.

As disclosed herein, an automatic document feeder, such as ADF 10, may be used to automatically transport media (one sheet or multiple sheets sequentially) along a media path, such as media path 12, from an input tray, such as input tray 15, to a scanning or imaging position, and then to an output tray, as an example of automated media tray 14. At the scanning or imaging position, the media may be scanned or imaged for copying, scanning, faxing, displaying on a monitor, or other processing. In examples, ADF 10 may be part of a printer, a scanner, a photocopier, a fax machine, or a multi-function or all-in-one device providing printing, scanning, copying, and/or faxing capabilities.

Figure 2:
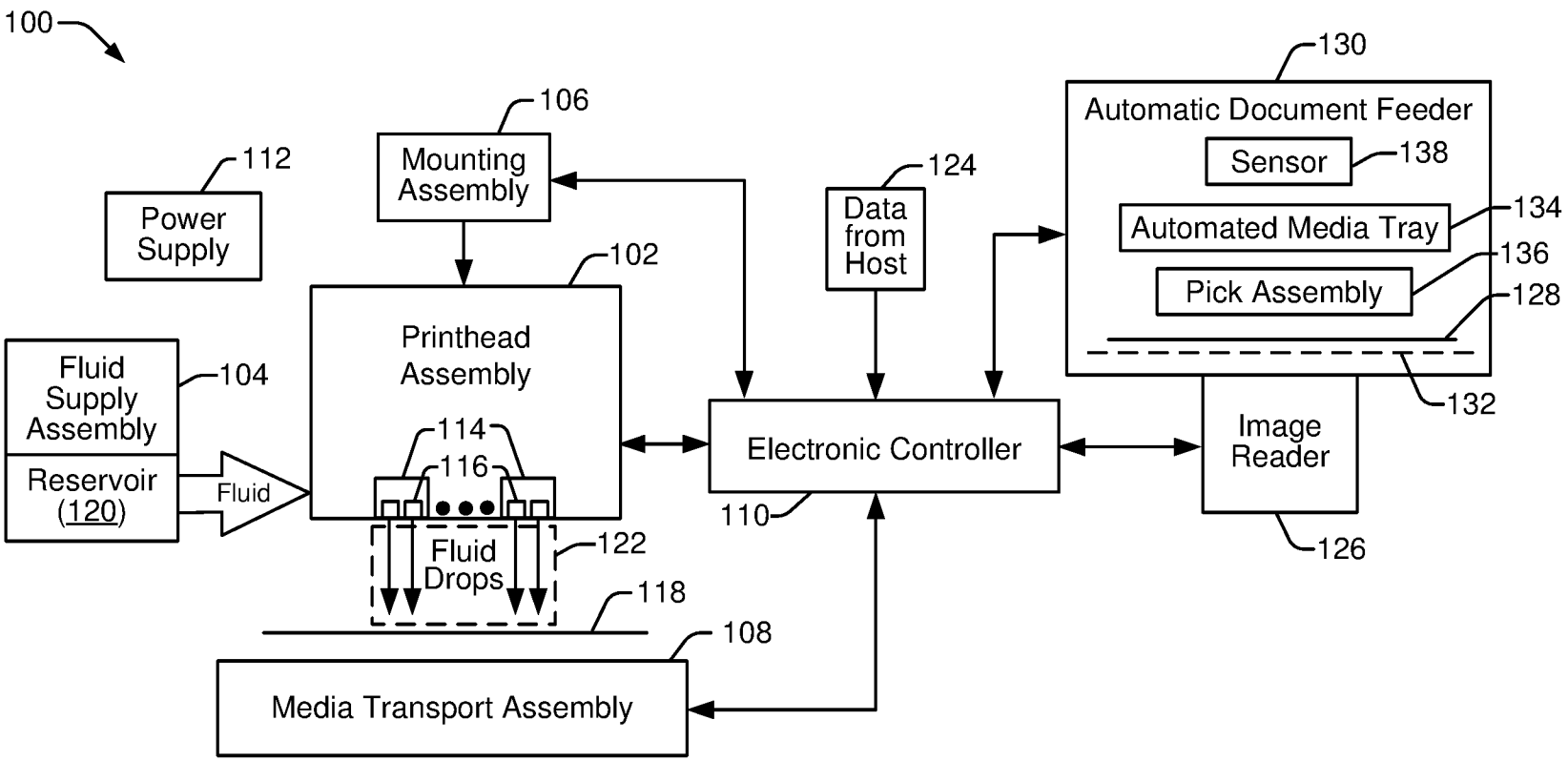
FIG. 2 is a block diagram illustrating an example of an inkjet printing system including an example of an automatic document feeder.

FIG. 2 illustrates an example of an inkjet printing system. Inkjet printing system 100 includes a printhead assembly 102, as an example of a fluid ejection assembly, a fluid (e.g., ink) supply assembly 104, a mounting assembly 106, a media transport assembly 108, an electronic controller 110, and a power supply 112 that provides power to electrical components of inkjet printing system 100. Printhead assembly 102 includes a printhead die 114, as an example of a fluid ejection die or fluid ejection device, that ejects drops of fluid through a plurality of orifices or nozzles 116 toward a print media 118 so as to print on print media 118.

Print media 118 can be any type of suitable sheet or roll material, such as paper, card stock, transparencies, Mylar, and the like, and may include rigid or semi-rigid material, such as cardboard or other panels. Nozzles 116 are arranged in columns or arrays such that properly sequenced ejection of fluid from nozzles 116 causes characters, symbols, and/or other graphics or images to be printed on print media 118 as printhead assembly 102 and print media 118 are moved relative to each other.

Fluid supply assembly 104 supplies fluid to printhead assembly 102 and, in one example, includes a reservoir 120 for storing fluid such that fluid flows from reservoir 120 to printhead assembly 102. In one example, printhead assembly 102 and fluid supply assembly 104 are housed together in an inkjet cartridge or pen. In another example, fluid supply assembly 104 is separate from printhead assembly 102 and supplies fluid to printhead assembly 102 through an interface connection, such as a supply tube.

Mounting assembly 106 positions printhead assembly 102 relative to media transport assembly 108, and media transport assembly 108 positions print media 118 relative to printhead assembly 102. Thus, a print zone 122 is defined adjacent to nozzles 116 in an area between printhead assembly 102 and print media 118. In one example, printhead assembly 102 is a scanning type printhead assembly. As such, mounting assembly 106 includes a carriage for moving printhead assembly 102 relative to media transport assembly 108 to scan print media 118. In another example, printhead assembly 102 is a non-scanning type printhead assembly. As such, mounting assembly 106 fixes printhead assembly 102 at a prescribed position relative to media transport assembly 108. Thus, media transport assembly 108 positions print media 118 relative to printhead assembly 102.

Electronic controller 110 includes a processor, firmware, software, memory components including volatile and non-volatile memory components, and other printer electronics for communicating with and controlling printhead assembly 102, mounting assembly 106, and media transport assembly 108. Electronic controller 110 receives data 124 from a host system, such as a computer, and temporarily stores data 124 in a memory. Data 124 is sent to inkjet printing system 100 along an electronic, infrared, optical, or other information transfer path. Data 124 represents, for example, a document and/or file to be printed. As such, data 124 forms a print job for inkjet printing system 100 and includes print job commands and/or command parameters.

In one example, electronic controller 110 controls printhead assembly 102 for ejection of fluid drops from nozzles 116. Thus, electronic controller 110 defines a pattern of ejected fluid drops which form characters, symbols, and/or other graphics or images on print media 118. The pattern of ejected fluid drops is determined by the print job commands and/or command parameters.

Printhead assembly 102 includes one (i.e., a single) printhead die 114 or more than one (i.e., multiple) printhead die 114. In one example, printhead assembly 102 is a wide-array or multi-head printhead assembly. In one implementation of a wide-array assembly, printhead assembly 102 includes a carrier that carries a plurality of printhead dies 114, provides electrical communication between printhead dies 114 and electronic controller 110, and provides fluidic communication between printhead dies 114 and fluid supply assembly 104.

In one example, inkjet printing system 100 is a drop-on-demand thermal inkjet printing system wherein printhead assembly 102 includes a thermal inkjet (TIJ) printhead that implements a thermal resistor as a drop ejecting element to vaporize fluid in a fluid chamber and create bubbles that force fluid drops out of nozzles 116. In another example, inkjet printing system 100 is a drop-on-demand piezoelectric inkjet printing system wherein printhead assembly 102 includes a piezoelectric inkjet (PIJ) printhead that implements a piezoelectric actuator as a drop ejecting element to generate pressure pulses that force fluid drops out of nozzles 116.

In examples, inkjet printing system 100 includes an automatic document feeder (ADF) 130, as an example of ADF 10, and an image reader 126 such that ADF 130 automatically transports media 128, as an example of media 2, along a media path 132, as an example of media path 12, to and/or past image reader 126. As such, image reader 126 may acquire and/or generate an image of a side or surface of media 128.

In one implementation, ADF 130 includes an automated media tray 134, as an example of automated media tray 14, to receive media 128 as output from media path 132 (e.g., an output tray). In examples, automated media tray 134 may be automatically positioned (for example, closed or opened, stowed or deployed, covered or uncovered, concealed or revealed, retracted or extended, non-communicated or communicated, inaccessible or accessible) based on input of media 128 to ADF 130, including, more specifically, input of media 128 to media path 132 of ADF 130.

In examples, input of media 128 to media path 132 is provided by a pick mechanism or pick assembly 136. More specifically, in implementations, ADF 130 includes pick mechanism or pick assembly 136 to pick media 128 from an input tray of ADF 130 and feed media 128 to media path 132. Pick mechanism or pick assembly 136 may include, for example, a pick roller to contact and pick media (i.e., a top sheet of media) from the input tray, and a drive system (e.g., motor, shaft, gearing) to rotate the pick roller.

In examples, automated media tray 134 is automatically positioned (for example, opened, deployed, uncovered, revealed, extended, communicated, accessible) with input of media 128 to media path 132, as provided by pick assembly 136. More specifically, with operation of pick assembly 136 to pick media 128 from an input tray and feed media 128 to media path 132, automated media tray 134 is automatically positioned to receive media 128 from media path 132. For example, in implementations, pick assembly 136 is operatively connected to or coupled with automated media tray 134 to control a position of automated media tray 134 with operation of pick assembly 136 to pick media 128 from an input tray (e.g., during operation of pick assembly 136 to pick media 128).

In examples, without input of media 128 to media path 132 and without media in automated media tray 134 (for example, with media 128 removed from automated media tray 134), automated media tray 134 is automatically positioned (for example, closed, stowed, covered, concealed, retracted, non-communicated, inaccessible) so as not to receive media 128 from media path 132.

In one implementation, ADF 130 includes a sensor 138 to sense the presence (or absence) of media 128 in automated media tray 134, and provide input to control the position of automated media tray 134. For example, without media 128 in automated media tray 134, as determined by sensor 138, and without input of media 128 to media path 132, automated media tray 134 is in (e.g., moved to or changed to) a closed position and, therefore, non-communicated with media path 132.

In one implementation, ADF 130, including automated media tray 134, pick assembly 136, and sensor 138, is communicated with electronic controller 110. As such, electronic controller 110 controls a position of automated media tray 134 based on input of media 128 to media path 132.

Figure 3A:
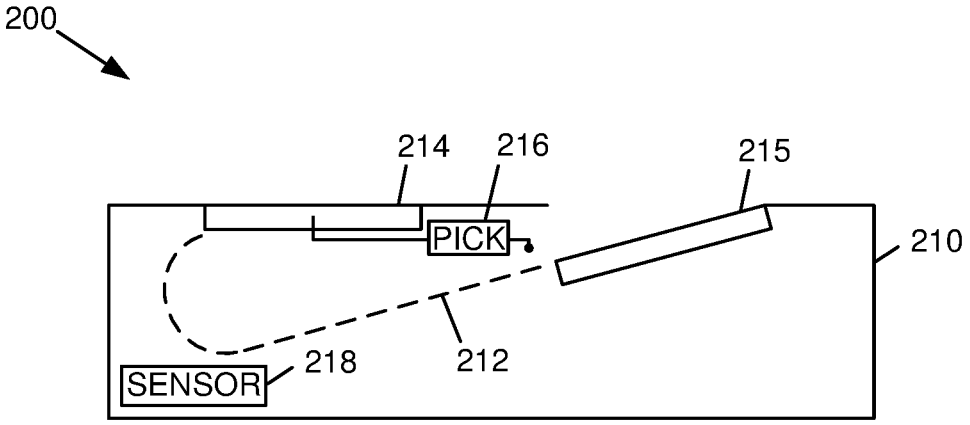
FIGS. 3A and 3B are block diagrams illustrating an example of an automatic document feeder including an automated media tray in a closed position and an open position, respectively.
Figure 3B:
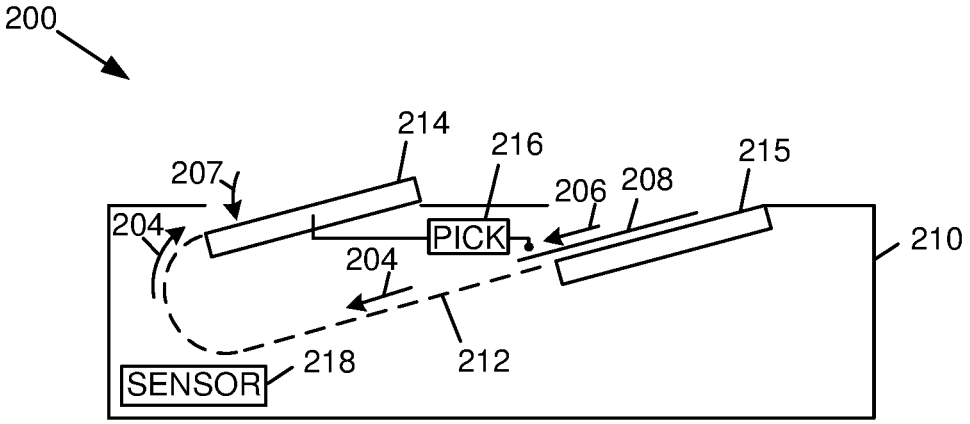

FIGS. 3A and 3B are block diagrams illustrating an example of an automatic document feeder (ADF) 200, as an example of ADF 130, including an automated media tray 214, as an example of automated media tray 134, in a closed position and an open position, respectively. In one implementation, as disclosed herein, automated media tray 214 may be automatically positioned (e.g., moved or changed between a first position and a second position) based on input of media 208 to ADF 200 including, more specifically, input of media 208 to a media path 212 of ADF 200.

As illustrated in the example of FIGS. 3A and 3B, ADF 200 includes a housing 210, media path 212, as an example of media path 132, within housing 210, and automated media tray 214 supported by housing 210. In examples, media path 212 includes a variety of guides, rollers, wheels, etc. to achieve handling and routing of media within and/or through ADF 200. In one example, automated media tray 214 is an output tray and receives and supports media as output from ADF 200. In addition, ADF 200 includes an input tray 215 that supports and supplies media for input to ADF 200.

As illustrated in the example of FIG. 3B, in an open position, as further described below, automated media tray 214 is positioned to communicate with an end of media path 212 (i.e., an output end). In addition, input tray 215 communicates with an opposite end of media path 212 (i.e., an input end). As such, media may be routed from input tray 215 to automated media tray 214 along media path 212, as represented by arrows 204.

As disclosed herein, automated media tray 214 may be automatically positioned (e.g., oriented, arranged, configured, operated, actuated) to selectively communicate with media path 212 or provide access to media path 212. For example, as illustrated in the example of FIG. 3A, automated media tray 214 is positioned not to communicate with or provide access to media path 212. More specifically, in the position of FIG. 3A, automated media tray 214 is in a closed, stowed, covered, concealed, or retracted position (collectively referred to herein as a "closed position" for simplicity) such that automated media tray 214 is not communicated with media path 212 (i.e., is non-communicated or uncommunicated with media path 212). In addition, as illustrated in the example of FIG. 3B, automated media tray 214 is positioned to communicate with or provide access to media path 212. More specifically, in the position of FIG. 3B, automated media tray 214 is in an open, deployed, uncovered, revealed, or extended position (collectively referred to herein as an "open position" for simplicity) such that automated media tray 214 is communicated with media path 212.

In one implementation, as disclosed herein, a position of automated media tray 214 may be established based on input of media 208 to media path 212. More specifically, with input of media 208 to media path 212, as represented by arrow 206, automated media tray 214 may be in (including, e.g., moved to or changed to) an open position, as illustrated, for example, in FIG. 3B. As such, automated media tray 214 communicates with media path 212, and ADF 200 is available for use. However, without input of media 208 to media path 212 (and without media 208 in automated media tray 214), automated media tray 214 may be in (including, e.g., moved to or changed to) a closed position, as illustrated, for example, in FIG. 3A. As such, automated media tray 214 does not communicate with media path 212, and ADF 200 is not available for use.

In examples, ADF 200 includes a pick mechanism or pick assembly 216, as an example of pick mechanism or pick assembly 136, to pick media 208 from input tray 215 of ADF 200 and feed media 208 to media path 212. Pick mechanism or pick assembly 216 may include, for example, a pick roller to contact and pick media (i.e., a top sheet of media) from input tray 215, and a drive system (e.g., motor, shaft, gearing) to rotate the pick roller. In implementations, pick mechanism or pick assembly 216 is operatively connected to or coupled with automated media tray 214 to move or change automated media tray 214 and establish the open position and the closed position of automated media tray 214.

For example, with operation of pick assembly 216 to pick media 208 from input tray 215 and feed media 208 to media path 212, automated media tray 214 is automatically positioned (e.g., moved or changed) to establish the open position and receive media 208 from media path 212. In one example, operation of the drive system of pick assembly 216 (or a component or components thereof) establishes the open position of automated media tray 214. In one implementation, automated media tray 214 is pivoted relative to housing 210, as illustrated in FIG. 3B and represented by arrow 207, to establish the open position (and pivoted in the opposite direction to establish the closed position).

In one example, without input of media 208 to media path 212, and without media 208 in automated media tray 214, automated media tray 214 may be in a closed position, as illustrated in the example of FIG. 3A. In one implementation, a presence (or absence) of media 208 in automated media tray 214 may be determined by or based on a reading of a sensor 218, as an example of sensor 138. As such, without media 208 in automated media tray 214, as sensed by sensor 218, and without input of media 208 to media path 212, by pick assembly 216, automated media tray 214 may be automatically moved to or changed to the closed position. In one example, automated media tray 214 is automatically moved to or changed to the closed position by pick assembly 216. More specifically, in one implementation, the drive system of pick assembly 216 (or a component or components thereof) is operated in reverse to establish the closed position of automated media tray 214.

FIGS. 4A, 4B, 4C, 4D, 4E, 4F are perspective views illustrating an example of an automatic document feeder (ADF) 300, as an example of ADF 10, 130, 200, including an automated media tray 314, as an example of automated media tray 14, 134, 214, in a closed position and an open position based on input of media to ADF 300. In the illustrated example, ADF 300 also includes an input tray 315, as an example of input tray 15, 215.

Figure 4A:
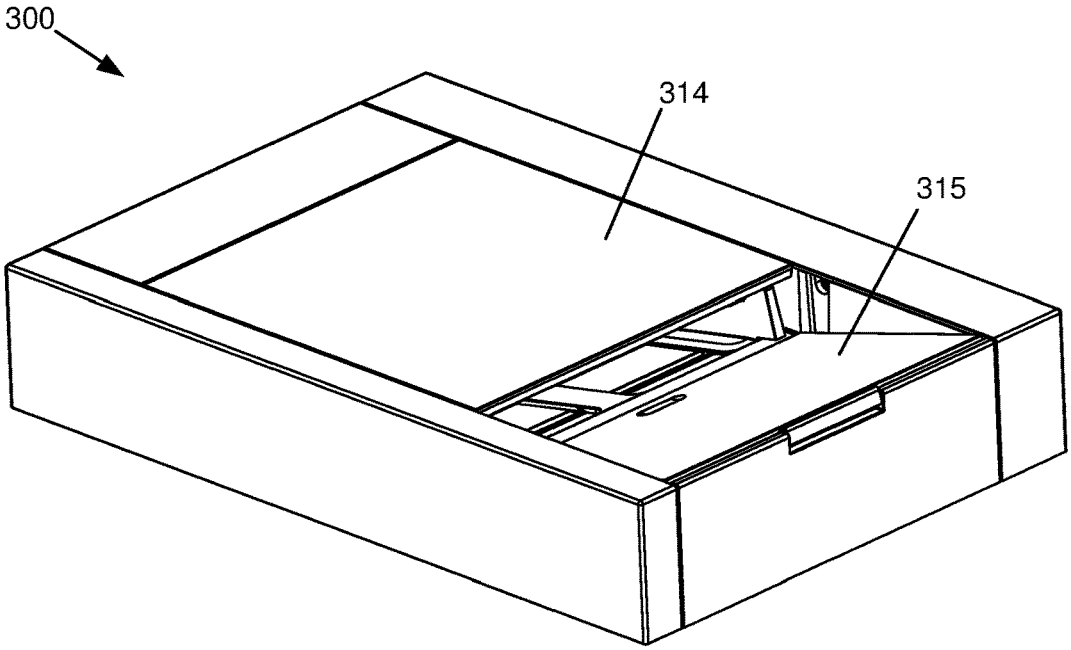
FIGS. 4A, 4B, 4C, 4D, 4E, 4F are perspective views illustrating an example of an automatic document feeder including an automated media tray in a closed position and an open position based on input of media to the automatic document feeder.

As illustrated in the example of FIG. 4A, automated media tray 314 of ADF 300 is in a closed position.

Figure 4B:
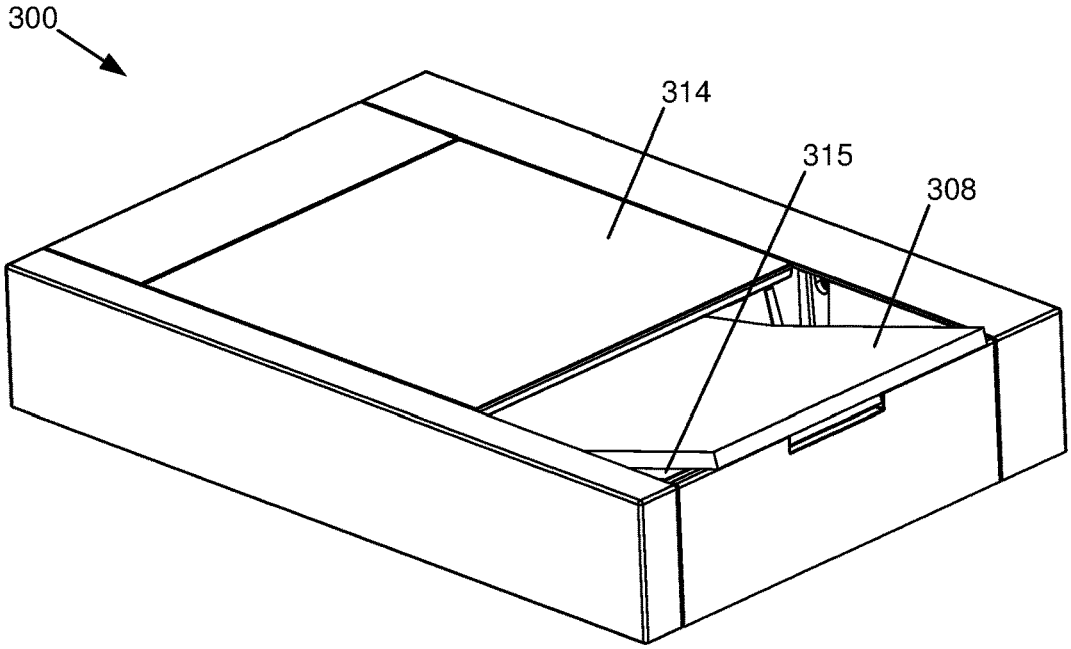

Thereafter, as illustrated in the example of FIG. 4B, with automated media tray 314 in the closed position, media 308 is placed on or inserted in input tray 315 of ADF 300.

Figure 4C:
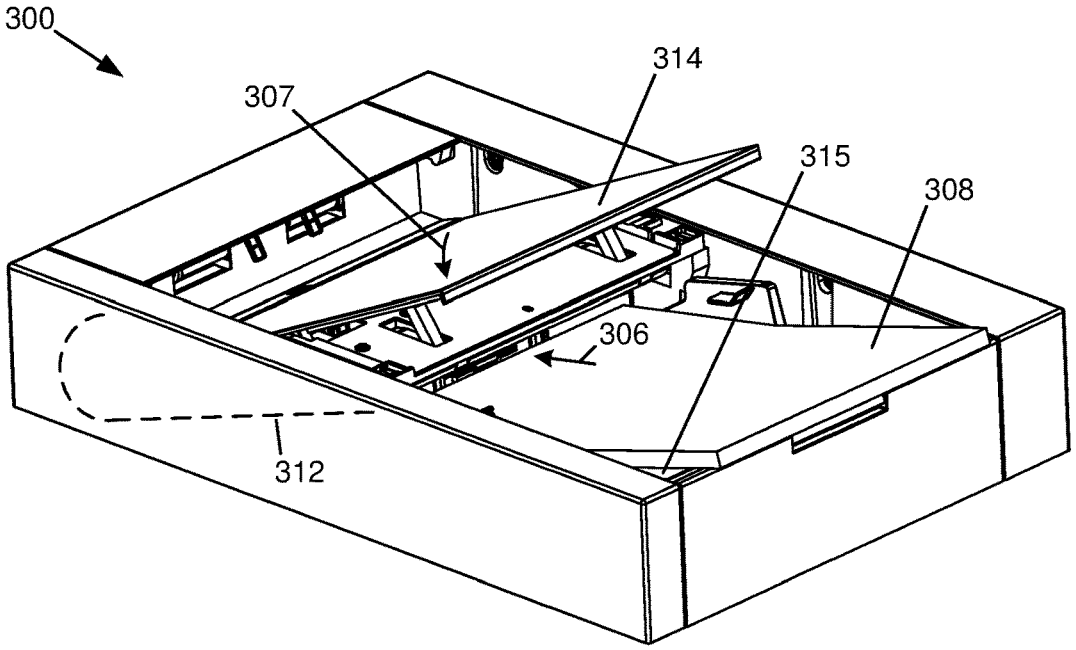

As such, as illustrated in the example of FIG. 4C, automated media tray 314 is automatically moved to or changed to an open position with input of media 308 to ADF 300, as represented by arrow 306. More specifically, with operation of a pick mechanism or pick assembly of ADF 300 (e.g., pick assembly 136, 216) to pick media 308 from input tray 315 and input media 308 to a media path of ADF 300, as schematically represented by broken line 312, automated media tray 314 is positioned (e.g., oriented, configured, arranged) to communicate with and receive media from media path 312. In one example, operation of a drive system of the pick mechanism or pick assembly (or a component or components thereof) establishes the open position of automated media tray 314. In one implementation, automated media tray 314 is pivoted, as represented by arrow 307, to establish the open position (and pivoted in the opposite direction to establish the closed position).

Figure 4D:
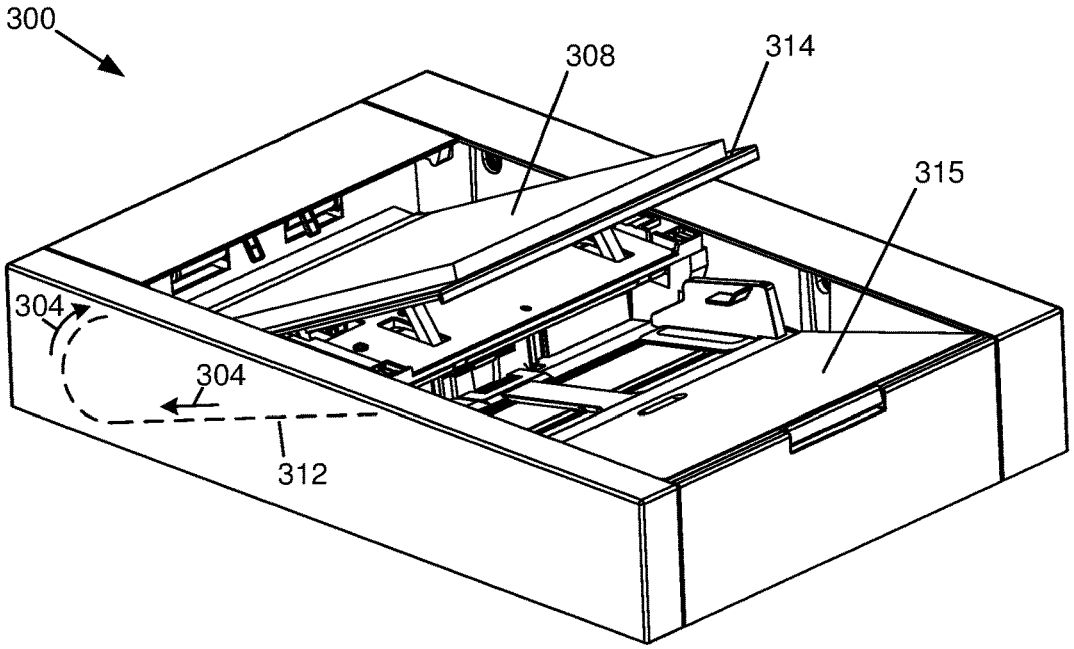

As illustrated in the example of FIG. 4D, with automated media tray 314 in the open position, media 308 is routed through ADF 200 (i.e., through media path 312 of ADF 300, as represented by arrows 304). As such, with automated media tray 314 in the open position, media 308 is received at automated media tray 314 as output from media path 312.

Figure 4E:
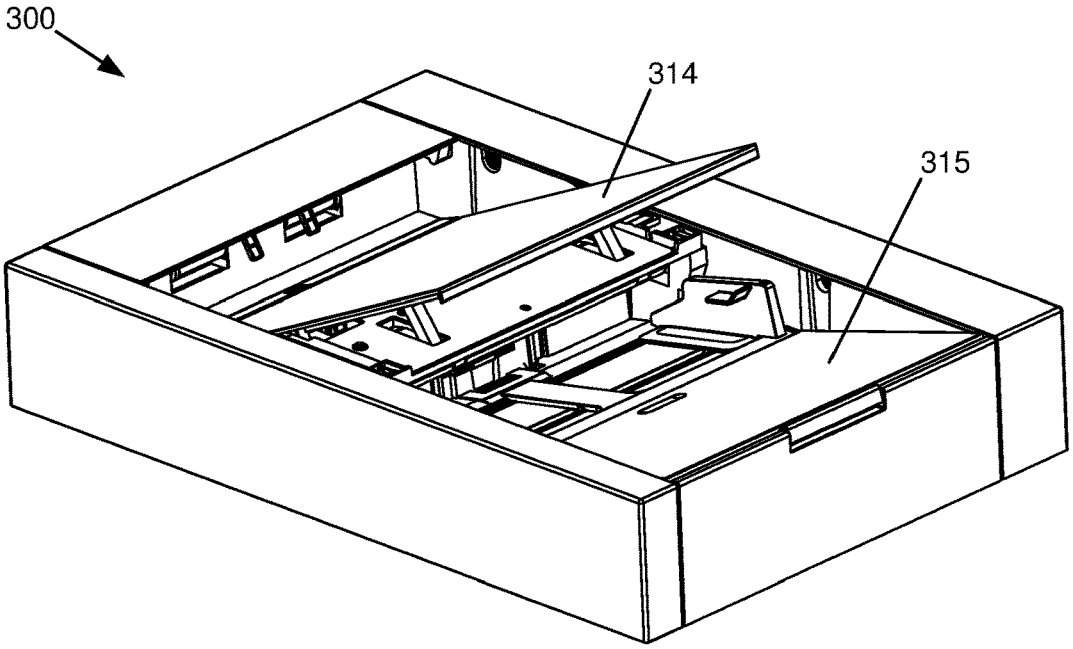

Thereafter, as illustrated in the example of FIG. 4E, media 308 is removed from ADF 300 (i.e., removed from automated media tray 314). In one implementation, removal of media from or absence of media in automated media tray 314 is detected by a sensor (e.g., sensor 138, 218).

Figure 4F:
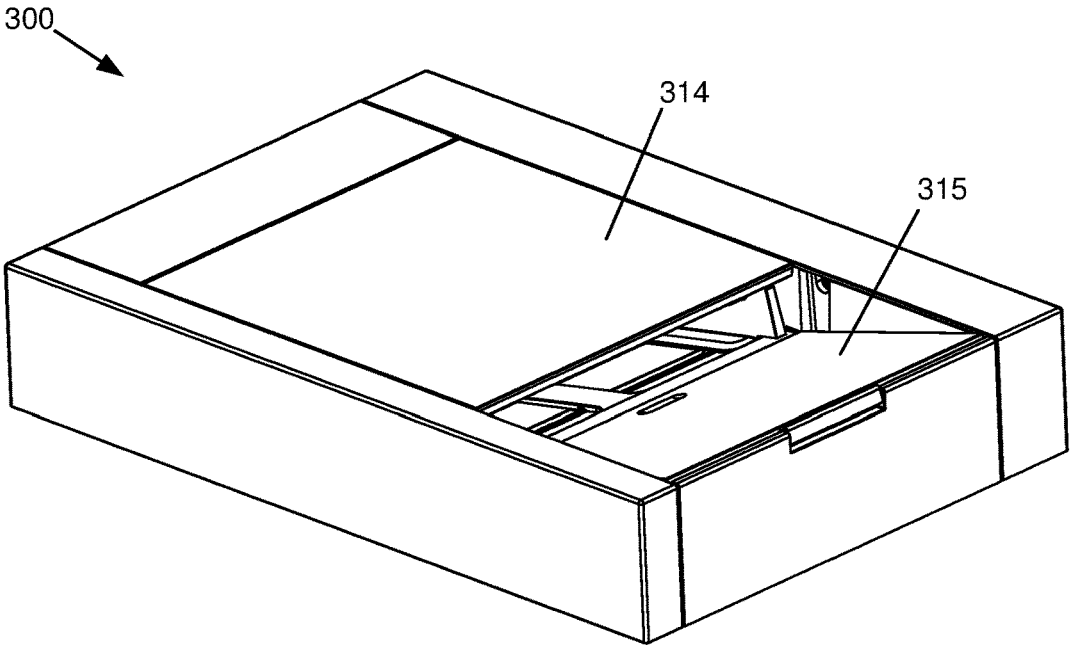

As illustrated in the example of FIG. 4F, when media 308 is removed from automated media tray 314, and without input (e.g., without additional or further input) of media to ADF 300, automated media tray 314 is automatically moved to or changed to the closed position. More specifically, in one example, the pick mechanism or pick assembly of ADF 300 is operated to automatically move or change automated media tray 314 to the closed position. For example, in one implementation, the drive system of pick assembly 216 (or a component or components thereof) is operated in reverse to establish the closed position of automated media tray 214. As such, automated media tray 314 is positioned (e.g., oriented, configured, arranged) so as not to communicate with and receive media from media path 312.

Figure 5:
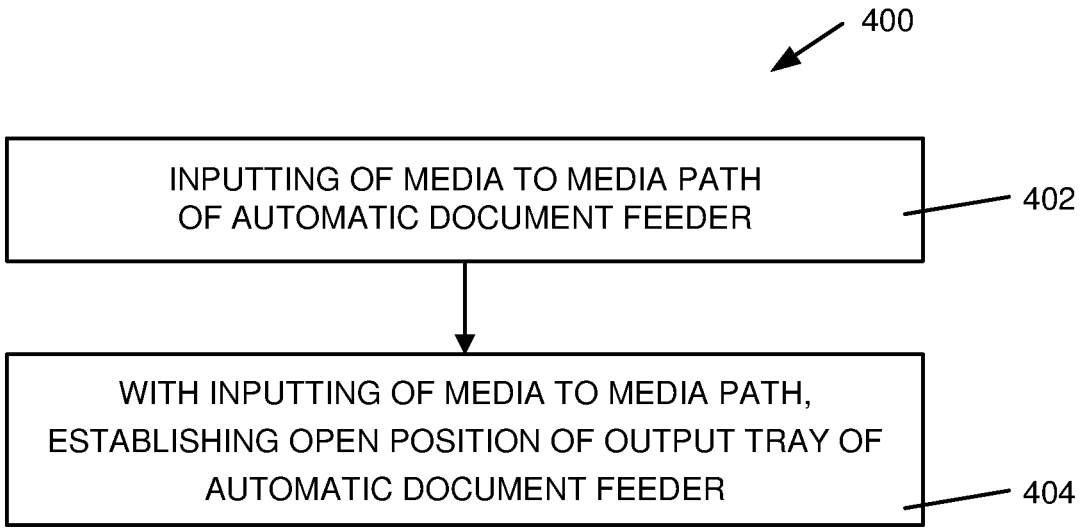
FIG. 5 is a flow diagram illustrating an example of a method of operating an automatic document feeder.

FIG. 5 is a flow diagram illustrating an example of a method 400 of operating an automatic document feeder, such as automatic document feeder 10, 130, 200, 300, as illustrated in the examples of FIGS. 1A and 1B, FIG. 2, FIGS. 3A and 3B, FIGS. 4A-4F, respectively.

At 402, method 400 includes inputting of media to a media path of the automatic document feeder, such as inputting of media 2, 128, 208, 308 to media path 12, 132, 212, 312 of automatic document feeder 10, 130, 200, 300, as illustrated in the examples of FIGS. 1A and 1B, FIG. 2, FIGS. 3A and 3B, FIGS. 4A-4F, respectively.

And, at 404, method 400 includes, with the inputting of media to the media path, establishing an open position of an output tray of the automatic document feeder, such as establishing an open position of automated media tray 14, 134, 214, 314 of automatic document feeder 10, 130, 200, 300, as illustrated in the examples of FIGS. 1A and 1B, FIG. 2, FIGS. 3A and 3B, FIGS. 4A-4F, respectively.

In one example, inputting of media to the media path at 402, includes picking of the media from an input tray of the automatic document feeder, such as picking media 2, 208, 308 from input tray 15, 215, 315 of automatic document feeder 10, 200, 300, respectively, as illustrated in the examples of FIGS. 1A and 1B, FIGS. 3A and 3B, FIGS. 4A-4F, and establishing the open position of the output tray at 404, includes rotating the output tray to the open position with the picking of the media from the input tray, such as rotating automated media tray 14, 214, 314 to the open position with the picking of media 2, 208, 308 from input tray 15, 215, 315, respectively, as illustrated in the examples of FIGS. 1A and 1B, FIGS. 3A and 3B, FIGS. 4A-4F.

As disclosed herein, an automatic document feeder and method of operating an automatic document feeder includes automated opening of a media tray of the automatic document feeder, including automated opening of an output tray of the automatic document feeder, based on input of media to a media path of the automatic document feeder. Automated opening of a media tray of the automatic document feeder, as disclosed herein, may improve user experience with the automatic document feeder, as the user will not have to manually open the media tray. When the automatic document feeder is not in use, automated closing of the media tray of the automatic document feeder, as disclosed herein, may improve the aesthetic appearance of the automatic document feeder by providing a more "sleek" or "clean" visual appearance to the automatic document feeder. In addition, automated closing of the media tray of the automatic document feeder when the automatic document feeder is not in use, may help to limit damage to the media tray, as the media tray (or portions thereof) may not protrude or extend from the automatic document feeder.

Although specific examples have been illustrated and described herein, it will be appreciated by those of ordinary skill in the art that a variety of alternate and/or equivalent implementations may be substituted for the specific examples shown and described without departing from the scope of the present disclosure. This application is intended to cover any adaptations or variations of the specific examples discussed herein.

The invention claimed is:

1. An automatic document feeder, comprising:
a media path to route media through the automatic document feeder;
an automated media tray to receive the media from the media path; and
a pick assembly, wherein the pick assembly is to:
pick and input the media to the media path;
position the automated media tray from a closed position to an open position based on input of the media to the media path; and
position the automated media tray from the open position to the closed position based on input of the media to the media path and media in the automated media tray.

2. The automatic document feeder of claim 1, wherein:
with the input of the media to the media path, the automated media tray to be in the open position, and
without the input of the media to the media path and without media in the automated media tray, the automated media tray to be in the closed position.

3. The automatic document feeder of claim 1, wherein:
with the input of the media to the media path, the automated media tray to be communicated with the media path, and
without the input of the media to the media path and without media in the automated media tray, the automated media tray to be non-communicated with the media path.

4. The automatic document feeder of claim 1, further comprising:
a sensor to sense the media in the automated media tray.

5. The automatic document feeder of claim 1, wherein the automated media tray comprises an output tray to receive the media from the media path; and further comprising:
an input tray to supply the media to the media path,
the output tray to be positioned based on the input of the media to the media path from the input tray.

6. An automatic document feeder, comprising:
an input tray to support media input to the automatic document feeder;
an output tray to support media output from the automatic document feeder;
a media path to route media from the input tray to the output tray; and
a pick assembly, wherein the pick assembly is to:
pick and input the media to the media path;
deploy the output tray from a closed position to an open position, based on a pick of media from the input tray; and
stow the output tray from the open position to the closed position, based on the pick of media from the input tray and media in the output tray.

7. The automatic document feeder of claim 6, with the pick of media from the input tray, the output tray to be pivoted from stowed to deployed.

8. The automatic document feeder of claim 7, without the pick of media from the input tray and with removal of media from the output tray, the output tray to be pivoted from deployed to stowed.

9. The automatic document feeder of claim 6, wherein:
the pick assembly picks the media, to be fed into the media path, from the input tray.

10. The automatic document feeder of claim 6, further comprising:
a media sensor to sense media in the output tray.

11. A method of operating an automatic document feeder, comprising:
inputting of media to a media path of the automatic document feeder by a pick assembly; and
based on inputting of media to the media path by the pick assembly, the pick assembly further establishing, from a closed position, an open position of an output tray of the automatic document feeder, and
based on inputting of media to the media path and media in the output tray, the pick assembly further establishing, from the open position, the closed position of the output tray of the automatic document feeder.

12. The method of claim 11, wherein:
the inputting of media to the media path comprises picking of the media from an input tray of the automatic document feeder, and
the establishing the open position of the output tray comprises utilizing the pick assembly to rotate the output tray to the open position with the picking of the media from the input tray.

13. The method of claim 11, wherein:

the establishing the open position of the output tray includes communicating the output tray with the media path.

14. The method of claim 11, further comprising:

routing the media through the media path to the output tray; and with removal of the media from the output tray and without further inputting of media to the media path, establishing the closed position of the output tray of the automatic document feeder.

15. The method of claim 14, wherein:

the establishing the closed position of the output tray includes non-communicating the output tray with the media path.

16. The method of claim 14, further comprises:

establishing the closed position of the output tray by pivoting the entire output tray, relative to a housing of the automatic document feeder, to the closed position.

* * * * *